US005628193A

United States Patent [19]

Kington et al.

[11] Patent Number: 5,628,193

[45] Date of Patent: May 13, 1997

[54] COMBUSTOR-TO-TURBINE TRANSITION ASSEMBLY

[75] Inventors: Harry L. Kington, Scottsdale; Craig W. Irwin, Tempe, both of Ariz.

[73] Assignee: AlliedSignal Inc., Morris Township, N.J.

[21] Appl. No.: 307,961

[22] Filed: Sep. 16, 1994

[51] Int. Cl.[6] ..... F23R 3/06

[52] U.S. Cl. ..... 60/752

[58] Field of Search ..... 60/751, 39.36, 60/760, 752, 757, 755, 39.75

[56] References Cited

U.S. PATENT DOCUMENTS

| | | | |
|---|---|---|---|
| 3,613,360 | 10/1971 | Howes | 60/39.36 |
| 3,691,766 | 9/1972 | Champion . | |
| 3,844,116 | 10/1974 | Matto | 60/39.36 |
| 3,869,864 | 3/1975 | Bunn | 60/39.36 |
| 4,339,925 | 7/1982 | Eggmann et al. | 60/760 |
| 4,567,730 | 2/1986 | Scott | 60/757 |
| 4,573,315 | 3/1986 | Stroem . | |
| 4,928,479 | 5/1990 | Shekleton et al. . | |
| 4,993,220 | 2/1991 | Shekleton et al. . | |
| 5,012,645 | 5/1991 | Reynolds . | |
| 5,033,263 | 7/1991 | Shekleton et al. | 60/760 |
| 5,058,375 | 10/1991 | Shekleton et al. . | |
| 5,062,262 | 11/1991 | Shekleton et al. . | |
| 5,237,813 | 8/1993 | Harris et al. | 60/39.36 |

FOREIGN PATENT DOCUMENTS

| | | | |
|---|---|---|---|
| 790851 | 7/1968 | Canada | 60/39.36 |
| 2723546 | 11/1978 | Germany | 60/39.36 |
| 2019947 | 11/1979 | United Kingdom | 60/39.36 |

*Primary Examiner*—Timothy S. Thorpe

*Attorney, Agent, or Firm*—Jerry J. Holden; James W. McFarland

[57] ABSTRACT

A transition assembly for directing the gas flow from a combustor to an axial turbine includes a transition liner having a shroud disposed about its outer surface and abutting thereto at a plurality of points to defining a plurality of cooling air passages therebetween. The downstream end of the assembly is circumscribed by the first stage stator and extends axially to just upstream of the first stage turbine rotor. At this end a plurality of circumferentially spaced struts are mounted between the liner and the shroud to define a plurality of axially facing nozzles which are angled to impart a pre-swirl to the cooling air exiting therefrom.

5 Claims, 1 Drawing Sheet

COMBUSTOR-TO-TURBINE TRANSITION ASSEMBLY

This invention relates to gas turbine engines, and in particular, to a transition assembly for directing the gas flow from the engine's combustor to its turbine.

BACKGROUND OF THE INVENTION

FIG. 3 shows a portion of prior art reverse flow annular combustor designated by reference numeral 2. An outer transition liner 6 has a shroud 5 disposed about its outer surface. The shroud 6 abuts the liner 6 at a plurality of points 4 to define cooling air passages 3 therebetween. The liner 6 is attached to a combustor wall 8 which has a plurality of holes for injection cooling air for dilution mixing with the hot combustion gas. Dilution mixing of this cool air with the hot combustion gas immediately downstream of the flame zone is well known in the art. The dilution air is used to properly mix the hot gas, thus eliminating hot spots or streaks in the gas flow and assuring a uniform temperature profile. During combustion, the liner 6 is exposed to the hot gas exiting the combustion chamber and therefore requires cooling. This cooling is provided by a portion of the high pressure air produced by the compressor 7, represented by arrows 9, which flows through the cooling passages 3 in a radially inward, (i.e. towards the engine centerline), direction exiting as low momentum air at the inner portion of the liner 6 and is then dumped into the gas stream upstream of the first stage turbine stator, not shown.

The amount of air flow through the cooling passages is a function of the pressure drop from the inlet of the cooling passages to their exit. The greater the pressure drop the larger the cooling flow. In the prior art, this pressure drop has been limited by two factors. First, prior art cooling passages only extend to just upstream of the first stage stator, and second, the first stage stators generate horseshoe vortices at their leading edges which produce local regions of increased pressure. Accordingly, there is need in gas turbine engines for a combustor-to-turbine transition assembly that overcomes the prior art limitations.

SUMMARY OF THE INVENTION

An object of the present invention is to increase the pressure drop across a transition liner disposed between a combustor and a turbine in a gas turbine engine.

Another object of the present invention is to provide a transition liner disposed between a combustor and a turbine in a gas turbine engine that is not affected by local horseshoe vortices produced by turbine stage stators.

The present invention achieves the above-stated objects by providing a combustor-to-turbine transition assembly that includes a transition liner having a shroud disposed about its outer surface and abutting thereto at a plurality of points to defining a plurality of cooling air passages therebetween. The downstream end of the assembly is circumscribed by the first stage turbine stator and extends axially to just upstream of the first stage turbine rotor. At this end a plurality of circumferentially spaced struts are mounted between the liner and the shroud to define a plurality of axially facing apertures. These apertures are configured as nozzles and to prevent losses due to unguided flow, the apertures or nozzles are angled to impart a pre-swirl to the cooling air exiting therefrom.

These and other objects, features and advantages of the present invention are specifically set forth in or will become apparent from the following detailed description of a preferred embodiment of the invention when read in conjunction with the accompanying drawing.

DESCRIPTION OF THE PREFERRED EMBODIMENT

Figure 1:
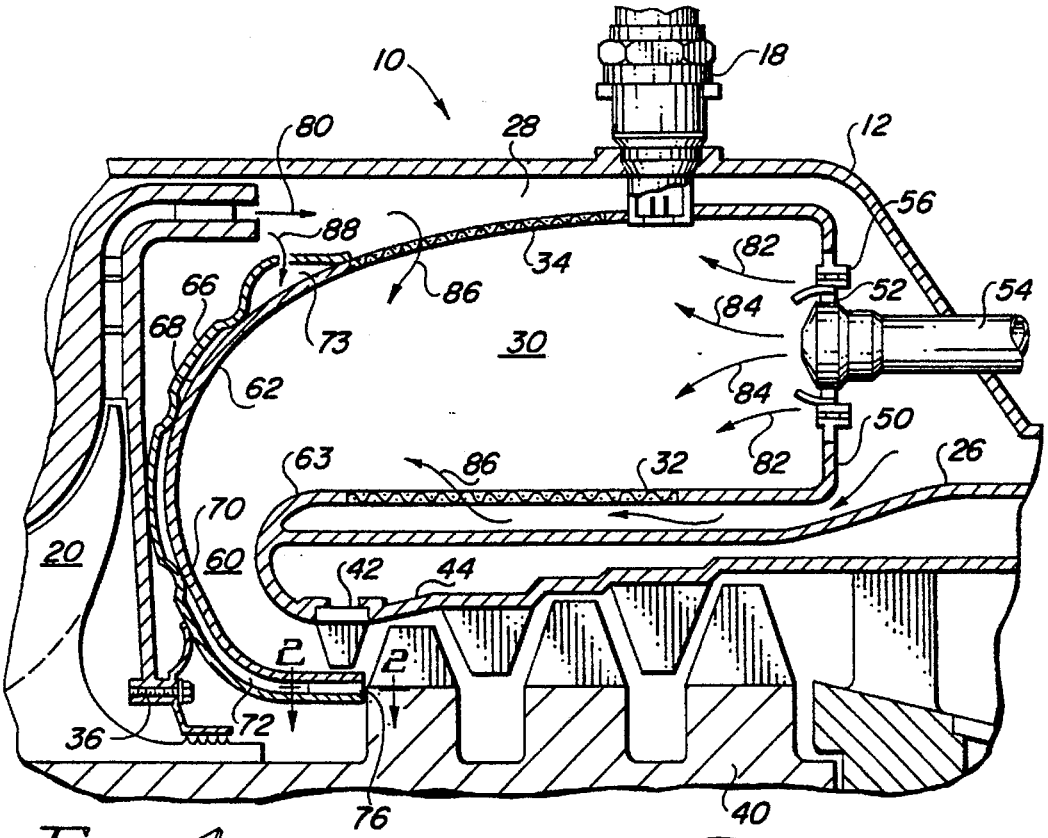
FIG. 1 is a plan view of a portion of a gas turbine engine having a combustor-to-turbine transition assembly as contemplated by the present invention.
Figure 2:
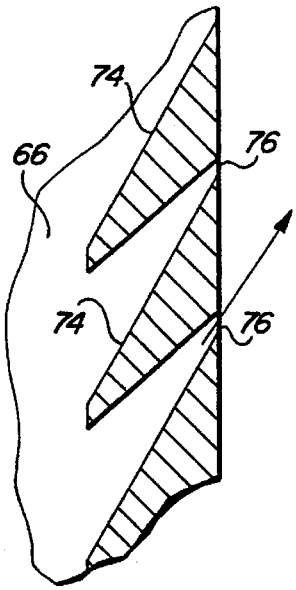
FIG. 2 is a view along line 2—2 of FIG. 1.

Referring to FIG. 1, a gas turbine engine to which the present invention relates is generally denoted by the reference numeral 10. The engine 10 operates in a conventional manner and includes an outer casing 12 circumscribing a centrifugal compressor 20 which discharges compressed air into a combustor 28, that encircles an axial expansion turbine 40 having a first stage stator 42 and a first stage rotor 44. The first stage stator 42 can either be individually mounted vanes or a conventional stator ring with the inner shroud removed. Each of these components is annular and symmetric about the engine centerline. Alternatively, the compressor 20 can be an axial compressor.

The combustor 28 includes an annular combustion chamber 30 mounted between an inner annular turbine wall 26 and the casing 12, and supported from an anchor point 36 where it is attached to the main frame of the engine 10. The annular combustion chamber 30 is defined by a pair of radially spaced apart, perforated, cylindrical walls 32 and 34, connected at the upstream end of the combustor chamber 30 by an annular wall 50. The combustor 28 is sometimes referred to as a reverse flow combustor because the mean direction of flow within the chamber 30 is opposite the general direction of flow through the engine 10.

The annular upstream wall 50 is provided with a plurality of equi-circumferentially spaced apertures 52 and a fuel injector 54 is positioned coaxial in each of the apertures 52. The upstream wall 50 also has a plurality of passages 56 for supplying air to the combustion chamber 30. An igniter 18 is mounted to the casing 12 and extends through the wall 34 into the chamber 30.

Figure 3:
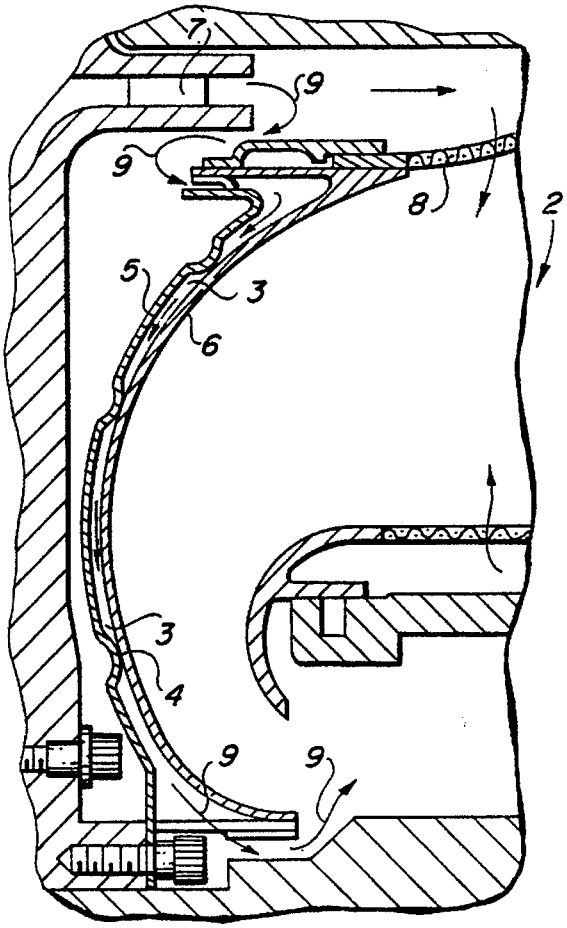
FIG. 3 (PRIOR ART)
FIG. 3 is a plan view of a prior art combustor transition liner.

On the downstream side of the chamber 30 is a transition assembly 60 that directs the hot gas flow generated in the chamber 30 to the turbine 40. The transition assembly 60 is comprised of a concave, annular transition liner 62 spaced apart from a concave, annular wall 63. The wall 63 extends from the wall 32 to the first stage stator 42. The liner 62 has an annular shroud 66 disposed about its back surface 68. The shroud 66 is spaced from the surface 68 except at plurality of points or dimples 70 at which the two abut. The dimples 70 define a plurality of cooling passages 72 between the liner 62 and the shroud 66. At its upstream end of the assembly 60, the liner 62 is either attached to, or integral with, the wall 34. At the downstream end of the assembly 60, the liner 62, shroud 66, and cooling passages 72 are circumscribed by the first stage stator 42, and extend axially to just upstream of the first stage rotor 44. Referring to FIG. 3, at this downstream end, a plurality of circumferentially spaced struts 74 are mounted between the liner 62 and shroud 66 to define a plurality of axially facing apertures 76 for the cooling passages 72. The struts 74 have a triangular shape so that the apertures act as nozzles. To prevent losses due to unguided flow, the apertures or nozzles 76 are angled to impart a pre-swirl to the cooling air exiting therefrom.

In operation, the compressor 20 delivers compressed air as represented by arrow 80. A first portion of the compressed air, represented by arrows 82, flows around the combustor chamber 30 and enters through air holes 56 in the upstream wall 50. This air is then mixed with fuel represented by arrows 84 and ignited to form a hot gas. A second portion of the compressed air, represented by arrow 86, flows through the perforated walls 32 and 34 and is used for dilution mixing of the hot gas. A third portion represented by arrows 88 enters the cooling passages 72 through holes 73 and flows radially inward cooling the back surface 68 of the liner 62. This cooling air then passes through the apertures or nozzles 76 and then into the engine gas flow stream just upstream of the first stage rotor 44.

Because the acceleration of the hot combustion gas through the stator 42 provides a large drop in static pressure, by extending the assembly 60 beneath the first stage stator 42, the pressure ratio across the cooling passages 72 increases and more cooling air flow is generated. Also, as the cooling flow enters the engine gas flow downstream of the stator 42 it is not affected by horseshoe vortices.

Though preferred embodiment the present invention was described in relation to a reverse flow annular combustor, it should be apparent to those skilled in the art that the invention is easily applied to an in-line annular combustor. An in-line or axial through flow combustor is identical to the combustor 28 except that the upstream wall 50 is rotated 180 degrees and as a result the liner 62 and wall 63 are no longer concave.

Various modifications and alterations to the above described invention will be apparent to those skilled in the art. Accordingly, the foregoing detailed description of the preferred embodiment of the invention should be considered exemplary in nature and not as limiting the scope and spirit of the invention as set forth in the following claims.

What is claimed is:

1. A gas turbine engine comprising:

a compressor;

an axial turbine having a first stage stator and a first stage rotor;

a combustion chamber receiving compressed air from said compressor, said chamber defined by an outer cylindrical wall circumscribing and spaced apart from an inner cylindrical wall, said walls being connected by an annular wall at the upstream end of said chamber; and a transition assembly for directing the gas flow generated in said combustion chamber to said turbine, said transition assembly having a first wall extending from said inner cylindrical wall to said first stage stator, and having a transition liner spaced from said first wall, said liner having a shroud disposed about its outer surface and abutting thereto at a plurality of points to define a plurality of cooling air passages between said outer surface and said shroud, said liner with said cooling air passages extending from said outer cylindrical wall to a downstream end portion disposed downstream of said first stage turbine stator.

2. The gas turbine engine of claim 1 wherein said downstream end portion includes at least one strut disposed between said liner and said shroud to define at least one axially facing aperture for said cooling passages.

3. The gas turbine engine of claim 2 wherein said aperture is configured as a nozzle.

4. The gas turbine engine of claim 3 wherein said aperture is angled relative to the direction of the cooling air flowing therethrough so as to direct the cooling air in the rotational direction of said first stage rotor.

5. The gas turbine engine of claim 2 wherein said aperture is just upstream of said first stage rotor.

* * * * *